US009752784B2

(12) United States Patent
Phillips et al.

(10) Patent No.: US 9,752,784 B2
(45) Date of Patent: Sep. 5, 2017

(54) HEATING ELEMENT CONTROL CIRCUIT

(71) Applicant: Electrolux Home Products, Inc., Charlotte, NC (US)

(72) Inventors: Bryan Thomas Phillips, Goodlettsvile, TN (US); Anthony Jenkins, Hendersonville, TN (US); Justin Woehler, Hendersonville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 158 days.

(21) Appl. No.: 14/336,158

(22) Filed: Jul. 21, 2014

(65) Prior Publication Data

US 2016/0018112 A1 Jan. 21, 2016

(51) Int. Cl.

| | |
|---|---|
| ***F24C 7/08*** | (2006.01) |
| ***H05B 1/02*** | (2006.01) |
| ***F24C 15/10*** | (2006.01) |
| ***H05B 6/06*** | (2006.01) |
| *H01H 37/12* | (2006.01) |
| *H01H 89/04* | (2006.01) |

(52) U.S. Cl.

CPC ..... *F24C 7/087* (2013.01); *F24C 15/10* (2013.01); *H05B 1/02* (2013.01); *H05B 1/0263* (2013.01); *H05B 1/0266* (2013.01); *H05B 6/062* (2013.01); *H01H 37/12* (2013.01); *H01H 89/04* (2013.01)

(58) Field of Classification Search

CPC ..... F24C 7/087; F24C 15/10; H05B 1/0263; H05B 1/0266; H05B 6/062

USPC ..... 219/490, 493, 494, 443.1, 446.1, 491

See application file for complete search history.

(56) References Cited

U.S. PATENT DOCUMENTS

| | | | | |
|---|---|---|---|---|
| 3,587,023 | A | 6/1971 | Goessler et al. | |
| 4,206,344 | A | 6/1980 | Fischer et al. | |
| 4,600,826 | A * | 7/1986 | Ishimura | H05B 6/6411 200/38 FA |
| 4,634,842 | A | 1/1987 | Payne | |
| 4,973,933 | A | 11/1990 | Kadlubowski | |
| 5,321,229 | A | 6/1994 | Holling et al. | |
| 5,349,162 | A | 9/1994 | Holling et al. | |

(Continued)

OTHER PUBLICATIONS

International Search Report issued for PCT/US2015/041157 dated Sep. 18, 2015, 2 pages.

*Primary Examiner* — David Angwin
*Assistant Examiner* — Justin Dodson
(74) *Attorney, Agent, or Firm* — Pearne & Gordon, LLP

(57) ABSTRACT

A power control circuit includes first and second electrical power terminals connected across a source of electrical power. A heating element is connected to the first terminal. A heating element controller is connected in series with the heating element, between the heating element and the second terminal. The controller is configured to control a temperature level of the element, and includes a control input configured to receive a range of temperature settings, and an OFF command for the element. The controller includes an ON/OFF switch to disconnect the element from the second terminal, and a temperature level control switch to intermittently connect/disconnect the element to the second terminal. A jumper wire series-connects the ON/OFF switch to the temperature level control switch. The ON/OFF switch, the jumper wire, the temperature level control switch, and the element are electrically connected in series.

23 Claims, 4 Drawing Sheets

(56) References Cited

U.S. PATENT DOCUMENTS

| | | | | |
|---|---|---|---|---|
| 5,378,874 | A | 1/1995 | Holling et al. | |
| 5,567,458 | A * | 10/1996 | Wu | A47J 27/004 219/433 |
| 6,043,461 | A | 3/2000 | Holling et al. | |
| 6,057,529 | A * | 5/2000 | Kirby | H05B 3/746 219/445.1 |
| 7,208,704 | B1 * | 4/2007 | Couts | H05B 1/0266 219/491 |
| 7,741,731 | B2 * | 6/2010 | Chiang | H02M 5/2576 219/660 |
| 2002/0185491 | A1 * | 12/2002 | Danko | F24H 9/2064 219/536 |
| 2006/0027563 | A1 | 2/2006 | Wilde et al. | |
| 2011/0147366 | A1 * | 6/2011 | Franca | H05B 1/0266 219/443.1 |
| 2011/0290782 | A1 * | 12/2011 | Donarski | H05B 1/0202 219/443.1 |
| 2012/0205365 | A1 | 8/2012 | Anton Falcon et al. | |

* cited by examiner

HEATING ELEMENT CONTROL CIRCUIT

BACKGROUND OF THE INVENTION

Field of the Invention

The present disclosure relates to power control circuits for appliances, and in particular to circuits for controlling the power to heating elements in appliances.

Description of Related Art

It is known to control the power to heating elements in appliances for the purpose of controlling and/or adjusting the temperature of the heating elements, and thus the temperature of a cooking vessel or oven cavity. This can be done using a so-called "infinite switch". The infinite switch intermittently opens and closes a power supply circuit for a heating element in accordance with a temperature setting of the infinite switch, and typically employs a bi-metallic strip and heater combination for this purpose. In a typical heating element power circuit employing an infinite switch, two separate power conductors extend from a source of electrical power to the infinite switch, and two additional power conductors extend from the infinite switch to the heating element. Due to the distances between the source of electrical power, the infinite switch, and the heating element, and due to the number of infinite switches used in the appliance, the aggregate length of the power conductors that supply power to the heating elements can be quite high. It would be desirable to reduce the number and/or length of the power conductors used to power the heating elements in the appliance.

BRIEF SUMMARY OF THE INVENTION

The following summary presents a simplified summary in order to provide a basic understanding of some aspects of the devices and systems discussed herein. This summary is not an extensive overview of the devices and systems discussed herein. It is not intended to identify critical elements or to delineate the scope of such devices and systems. Its sole purpose is to present some concepts in a simplified form as a prelude to the more detailed description that is presented later.

In accordance with one aspect, provided is a power circuit for an appliance. The power control circuit includes a first electrical power terminal and a second electrical power terminal, for connection across a source of electrical power. A heating element is electrically connected to the first electrical power terminal. A heating element controller is electrically connected in series with the heating element, between the heating element and the second electrical power terminal. The heating element controller is configured to control a temperature level of the heating element. The heating element controller includes a control input configured to receive a range of temperature settings for the heating element, and configured to receive an OFF command for a heating element. The heating element controller includes an ON/OFF switch operatively connected to the control input and having ON and OFF states selectively controlled by the control input. The ON/OFF switch is configured to disconnect the heating element from the second electrical power terminal when in the OFF state. The heating element controller includes a temperature level control switch operatively connected to the control input, and configured to intermittently connect the heating element to and disconnect the heating element from the second electrical power terminal in accordance with the temperature setting of the control input. A jumper wire electrically connects the ON/OFF switch to the temperature level control switch such that the ON/OFF switch and the temperature level control switch are connected to each other in series. The ON/OFF switch, the jumper wire, the temperature level control switch, and the heating element are electrically connected in series such that electrical power from the source of electrical power is provided to the heating element through the ON/OFF switch, the temperature level control switch, and the jumper wire electrically connecting the ON/OFF switch to the temperature level control switch.

In accordance with another aspect, provided is a power control circuit for an appliance. The power control circuit includes a first electrical power terminal and a second electrical power terminal, for connection across a source of electrical power. A heating element is electrically connected to the first electrical power terminal. An infinite switch is electrically connected in series with heating element, between the heating element and the second electrical power terminal. The infinite switch is configured to control a temperature level of the heating element. The infinite switch includes a control knob having a range of temperature setting positions for the heating element and an OFF position for the heating element. The infinite switch includes an ON/OFF switch operatively connected to the control knob through a cam device, and having ON and OFF states selectively controlled by the control knob. The ON/OFF switch is configured to disconnect the heating element from the second electrical power terminal when the control knob is in the OFF position. The infinite switch includes a temperature level control switch operatively connected to the control knob through the cam device, and configured to intermittently connect the heating element to and disconnect the heating element from the second electrical power terminal in accordance with a temperature setting position of the control knob. A jumper electrically connects the ON/OFF switch to the temperature level control switch such that the ON/OFF switch and the temperature level control switch are connected to each other in series. The ON/OFF switch, the jumper, the temperature level control switch, and the heating element are electrically connected in series such that electrical power from the source of electrical power is provided to the heating element through the ON/OFF switch, the temperature level control switch, and the jumper electrically connecting the ON/OFF switch to the temperature level control switch.

In accordance with another aspect, provided is a cooking appliance. The cooking appliance includes a cabinet formation of an oven cavity, a cooktop including a heating element, and a user interface including a control input for the heating element and a pilot device for the heating element. The cooking appliance includes a power control circuit for the heating element. The power control circuit includes a first electrical power terminal and a second electric power terminal for connection across a source of electrical power. The heating element is electrically connected to the first electrical power terminal. An infinite switch is electrically connected in series with the heating element between the heating element and the second electrical power terminal. The infinite switch is configured to control a temperature level of the heating element. The infinite switch includes the control input, wherein the control input includes a range of temperature setting positions for the heating element and an OFF position for the heating element. An ON/OFF switch is operatively connected to the control input, and has ON and OFF states selectively controlled by the control input. The ON/OFF switch is configured to disconnect the heating element from the second electrical power terminal when the control input is in the OFF position, wherein the ON/OFF switch has a pilot terminal configured to supply electrical power from the source of electrical power to the pilot device when the ON/OFF switch is in the ON state. A temperature level control switch is operatively connected to the control input, and configured to intermittently connect the heating element to and disconnect the heating element from the second electrical power terminal in accordance with a temperature setting position of the control input. A jumper wire is included in an appliance wiring harness and electrically connects an ON/OFF switch terminal of the infinite switch to a temperature level control switch terminal of the infinite switch such that the ON/OFF switch and the temperature level control switch are connected to each other in series. The ON/OFF switch, the jumper wire, the temperature level control switch, and the heating element are electrically connected in series such that electrical power from the source of electrical power is provided to the heating element through the ON/OFF switch, the temperature level control switch, and the jumper wire electrically connecting the ON/OFF switch to the temperature level control switch.

DETAILED DESCRIPTION OF THE INVENTION

Figure 1:
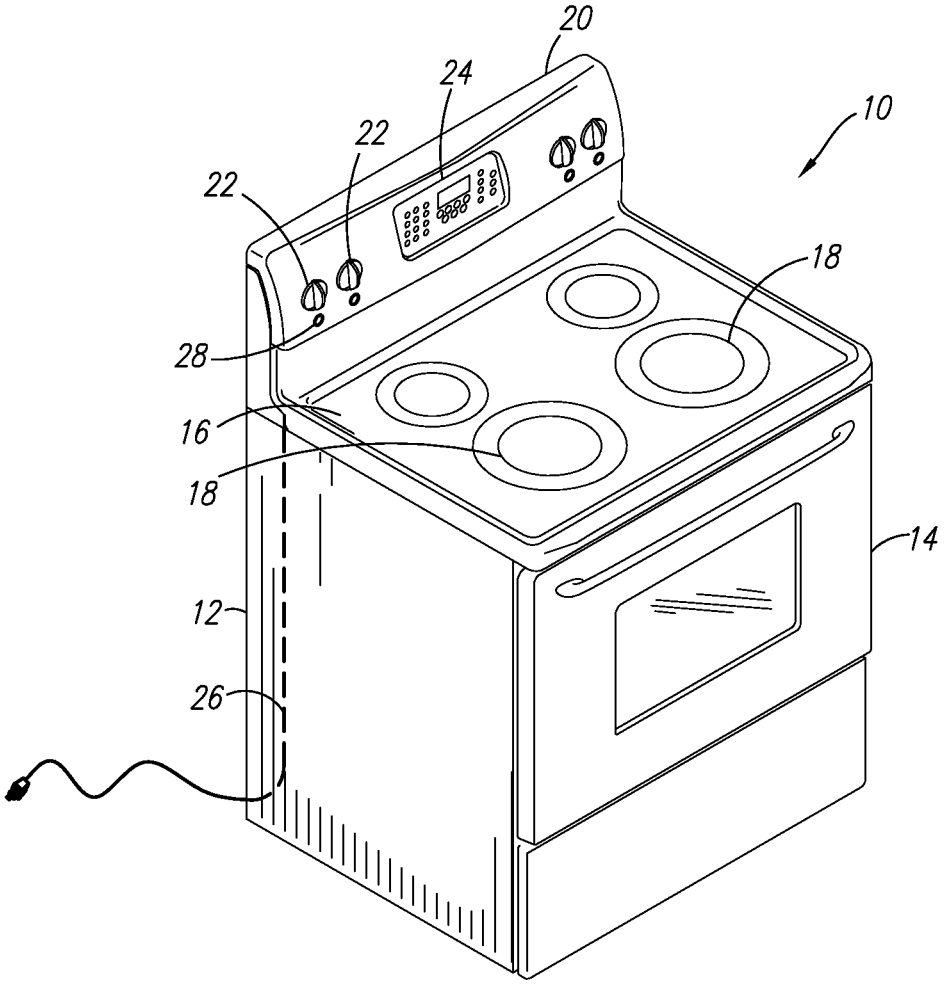
FIG. 1 is a front perspective view of a cooking appliance.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

The present subject matter is generally directed to a power control circuit for an electric heating element of an appliance, in particular a cooking appliance. FIG. 1 provides a perspective view of one example of a cooking appliance 10. The cooking appliance 10 is shown as a freestanding range. However, it is to be appreciated that the appliance need not be a freestanding range, but could be any other type of appliance employing a heating element, such as a built-in wall oven or cooktop, cooking hob, hotplate, or the like.

The cooking appliance 10 includes a housing or cabinet 12. The cabinet 12 forms and oven cavity that is closed by a door 14. The oven cavity is heated by heating elements (not shown) so that food can be cooked within the oven cavity. The cooking appliance 10 further includes a cooktop 16 having a plurality of heating elements 18 for heating cooking vessels placed onto the cooktop. The cooking appliance 10 also includes a user interface panel 20 having various control inputs 22, 24 or user interface devices that allow a user to control the operations of the cooking appliance 10. For example, via the various control inputs 22, 24, the user can activate, deactivate, set cooking temperatures or other parameters, input various commands (e.g., an OFF command) for the heating elements 18 of the cooktop and the heating elements of the oven cavity.

The control inputs 22, 24 can be a part of various types of input devices known in the art of cooking appliances for controlling the temperature or power level of heating elements. For example, the control inputs 22, 24 for the cooktop heating elements 18 and oven can include the knob portions of infinite switches, potentiometers, rotary encoders, and the like. The control inputs 22, 24 can also include other types of input devices, such as pushbuttons, touch switches, etc.

In certain embodiments, the control inputs 22, 24 are part of a device that directly controls the electrical power supplied to the heating elements (e.g., the control inputs 22, 24 are part of a device within the power circuit for a heating element). For example, electromechanical infinite switches can directly control the average power consumed by a heating element through the use of a bi-metallic strip and heater combination that intermittently opens and closes the power circuit to the heating element. Alternatively, the control inputs 22, 24 can be part of a device or system that indirectly controls the electrical power supplied to the heating elements. For example, the power control circuit for a heating element can employ controlled switches, such as relays or transistors, that intermittently turn ON and OFF to control the average power consumed by the heating element. Such power control circuits can further include a processor, such as a microprocessor or microcontroller, in communication with the control inputs 22, 24 for receiving temperature settings from the control inputs. Based on the temperature settings, the processor controls the operation of the switches (relays, transistors, etc.) within the power control circuits for the various heating elements, to thereby control the average power consumed by the heating elements. In such a scenario, the control inputs 22, 24 indirectly control the electrical power supplied to the heating elements via the processor.

For ease of explanation, the power control circuits discussed herein will be described as employing infinite switches as heating element controllers that directly control electrical power supplied to heating elements. The infinite switches have a knob 22 for use as the control input to allow the user to activate or input an ON command for the heating element, deactivate or input an OFF command for the heating element, and set a temperature for the heating element within a range of possible temperature settings. It is to be appreciated that the power control circuits discussed herein could employ other types of heating element controllers having control inputs, switching devices, and/or one or more processors as discussed above.

Figure 2:
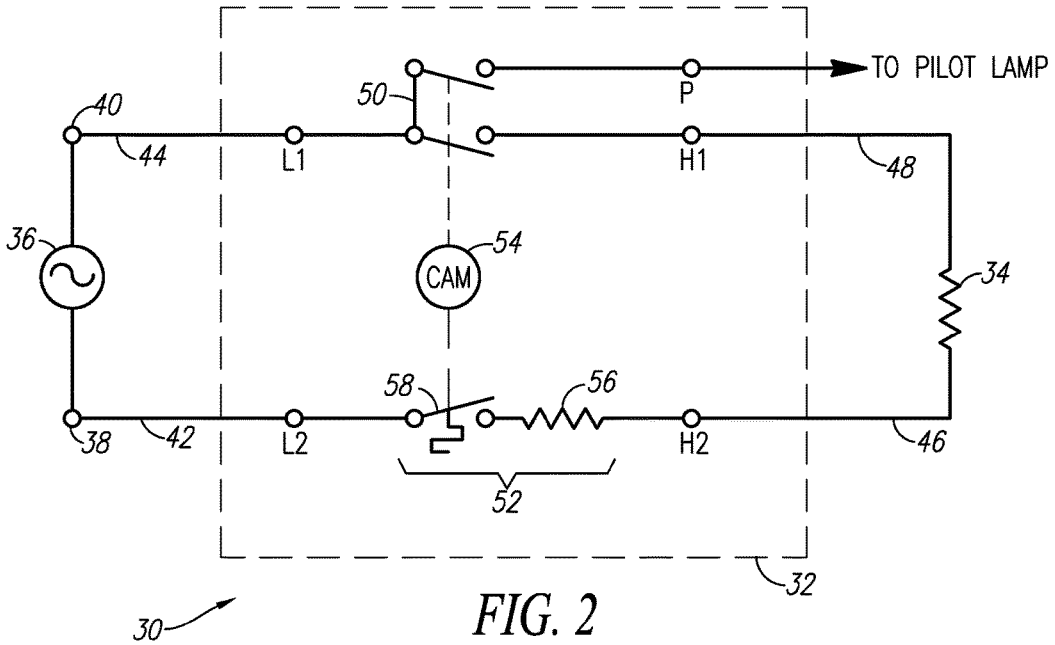
FIG. 2 is a schematic diagram of a power control circuit for a heating element.

Turning to FIG. 2, a conventional power control circuit 30 for an appliance's heating element is shown. The power control circuit 30 includes an infinite switch 32 for controlling the temperature level of, or average power consumed by, a heating element 34. The infinite switch 32 is connected between a source of electrical power 36 and the heating element 34, to control the consumption of electrical energy by the heating element 34 (e.g., to turn heating element ON an OFF, or selectively energize and de-energize the heating element).

The source of electrical power 36 ("source") can be a commercial single-phase power source. For example, the source 36 can be a 120/240 VAC split-phase power source having a grounded neutral, as commonly found in North America. Of course, other voltage configurations of the source 36 are possible, such as those commonly used outside of North America. The source 36 could also be a separately derive system within the appliance itself, such as the output of a transformer within the appliance.

The source 36 is connected to the power control circuit 30 via a first electrical power terminal 38 and a second electric power terminal 40. The first electrical power terminal 38 and the second electric power terminal 40 allow the infinite switch 32 and heating element 34 to be connected across the source 36. The first electrical power terminal 38 and the second electric power terminal 40 can be part of a plug on a power cable for the appliance, and the source 36 can be a receptacle for the plug or a supply system for the receptacle. The first electrical power terminal 38 and the second electrical power terminal 40 can also be terminals within the appliance, and the source 36 can be the plug and/or power cable for the appliance, a transformer within the appliance, etc.

The terms "first electrical power terminal" and "second electric power terminal" are used solely for convenience of explanation, and either power terminal 38, 40 could be considered a first electrical power terminal or a second electrical power terminal.

A typical infinite switch 32 has five terminals to which external connections can be made. The five terminals are conventionally identified as L1, L2, H1, H2, and P. The L1 and L2 terminals are line terminals or power input terminals that are connected to the source 36 via the first and second electrical power terminals 38, 40. Electrical power is supplied from the source 36 to the infinite switch 32, and ultimately to heating element 34, over line conductors 42, 44. The line conductors 42, 44 extend between the first and second electrical power terminals 38, 40 and the line terminals L2, L1 of the infinite switch. The line conductors 42, 44 can be part of a wiring harness 26 (FIG. 1) within the appliance 10.

The H1 and H2 terminals are heating element terminals or power output terminals of the infinite switch 32. The infinite switch 32 delivers power to the heating element 34 over load conductors 46, 48 that extend between the heating element 34 and the heating element terminals H2, H1 of the infinite switch. The load conductors 46, 48 can be part of the wiring harness 26 (FIG. 1).

It can be seen in FIG. 2 that in the conventional power control circuit 30, four separate conductors 42, 44, 46, 48 are run to the infinite switch 32 to supply power to the heating element 34.

The infinite switch 32 further includes a pilot terminal P. The pilot terminal P is connected to a pilot device, such as a pilot lamp 28 (FIG. 1), to indicate that the heating element 34 is operating. The wiring between the pilot device and the infinite switch 32 can also be part of the appliance's wiring harness 26 (FIG. 1).

The infinite switch 32 acts as a heating element controller to control the temperature level of or average power consumed by the heating element 34. The operation of the infinite switch 32 will now be described. The infinite switch 32 has two separate switches 50, 52 that interrupt power to the heating element 34. One switch is an ON/OFF switch 50, the other is a temperature level control switch 52. The switches 50, 52 are configured to separately interrupt power along different "hot" or energized conductors from the source 36, or one of the switches is configured to interrupt power along a "hot" conductor and the other switch is configured to interrupt power along a neutral or grounded conductor, depending on the voltage level to be applied to the heating element 34.

The operation of the ON/OFF switch 50 is controlled by an actuator, such as a cam device 54. Through the cam device 54, the ON/OFF switch 50 can be operatively connected to a control input (e.g., a knob) that is operated by a user to activate the heating element 34. For example, the knob can be attached to the cam device 54. When the knob and cam device 54 are rotated from an OFF position, a cam surface on the cam device 54 closes the ON/OFF switch 50. At the same time, the temperature level control switch 52 within the infinite switch 32 is closed by another cam surface of the cam device 54, thereby completing the power supply circuit to the heating element 34. Power is also supplied to the pilot device via the pilot terminal P when the ON/OFF switch 50 is closed. The heating element 34 can be de-energized by returning the knob and cam device 54 to the OFF position.

It can be seen that the power input terminal L1 is located or connected across the ON/OFF switch 50 from the power output terminal H1. Similarly, the power input terminal L2 is located or connected across the temperature level control switch 52 from the power output terminal H2. The terminals L1 and H1 can be constructed as parts of the ON/OFF switch, and the terminals L2 and H2 can be constructed as parts of the temperature will control switch 52. The pilot terminal P can also be constructed as part of the ON/OFF switch 50.

As current flows in the power control circuit 30, a small heater 56 in the temperature level control switch 52 heats a bi-metallic strip 58. As the bi-metallic strip 58 warms, it bends and eventually opens the switch 52, thereby de-energizing the heating element 34. With the power control circuit 30 open, the bi-metallic strip 58 cools and eventually closes the switch 52, thereby energizing the heating element 34 again. Thus, the temperature level control switch 52 is configured to intermittently connect the heating element 34 to, and disconnect the heating element from, the power source 36. The control knob attached to the cam device 54 is configured to receive a range of temperature settings for the heating element 34. The frequency of the intermittent operation the bi-metallic strip 58 is determined by the position of the cam device 54 and the control knob within its range of available temperature setting positions.

Figure 3:
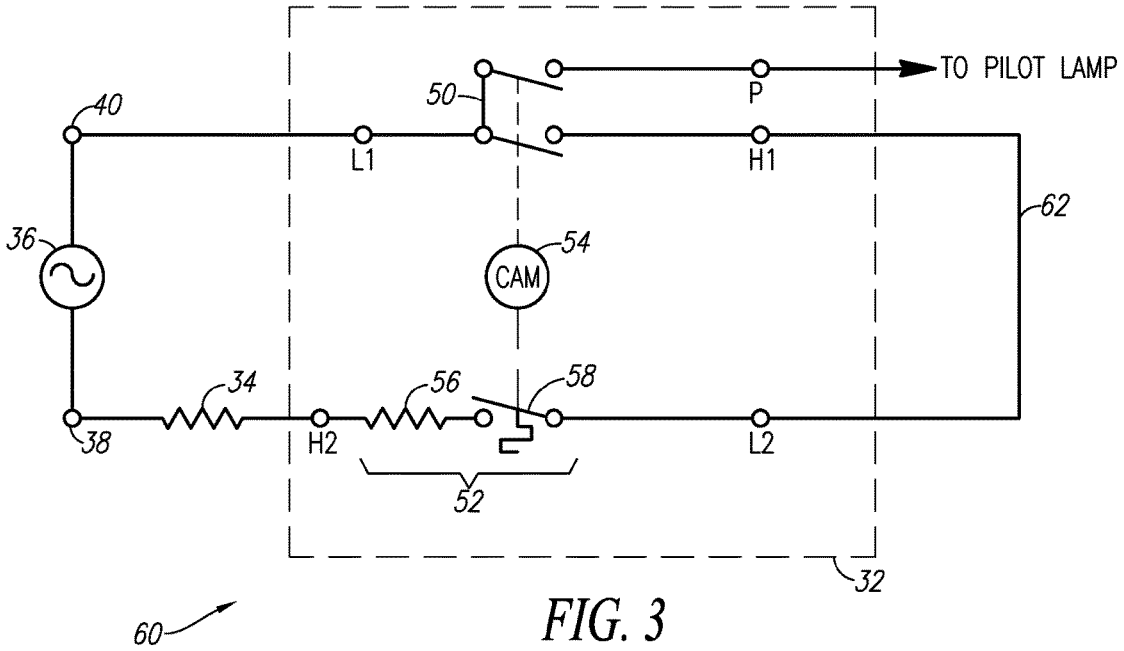
FIG. 3 is a schematic diagram of a power control circuit for a heating element.

FIG. 3 shows an example power control circuit 60 that requires fewer wires to be run to the infinite switch 32, and can reduce the overall length of wire used and the complexity of the wiring, as compared to the circuit 30 shown in FIG. 2. The power control circuit 60 includes a jumper, such as a jumper wire 62, that electrically connects the ON/OFF switch 50 to the temperature level control switch 52. It can be seen that the output terminal H1 of the ON/OFF switch 50 is directly connected to the input terminal L2 the temperature level control switch 50 via the jumper wire 62, and that the ON/OFF switch 50 and the temperature level control switch 52 are directly connected to each other in series. The ON/OFF switch 50 and the temperature level control switch 52 are configured to interrupt power along the same hot conductor from the source 36, rather than along different conductors from the source as in the circuit 30 shown in FIG. 2.

Instead of being connected to the output terminals H1, H2 of the infinite switch 32, the heating element 34 is electrically connected between: (a) one output terminal H2 of the infinite switch 32, and (b) the first electrical power terminal 38 connected to the source 36. Thus, one end of the heating element 34 is directly connected to the power source 36 and the other end of the heating element is directly connected to the infinite switch 32. The controller for the heating element controller, i.e., infinite switch 32, is electrically connected in series with the heating element 34, between the heating element and the second electrical power terminal 40 at the source 36. Both the ON/OFF switch 50 and the temperature level control switch 52 are configured to disconnect the heating element 34 from the second electrical power terminal 40. The ON/OFF switch 50 disconnects the heating element 34 from the second electrical power terminal 40 when in the OFF state due to the cam device 54 and knob being in the OFF position. The temperature level control switch 52 intermittently connects the heating element 34 to and disconnects the heating element from the second electrical power terminal 40 in accordance with the temperature setting of the cam device 54 and knob.

The ON/OFF switch 50, the jumper wire 62, the temperature level control switch 52, and the heating element 34 are all electrically connected in series, in that order. Electrical power from the source 36 is provided to the heating element 34 through the ON/OFF switch 50, the jumper wire 62, and the temperature level control switch 52.

The jumper wire 62 electrically connecting the ON/OFF switch 50 to the temperature level control switch 52 can be included in the appliance wiring harness 26 (FIG. 1). With the infinite switch 32 switching or breaking only one conductor (e.g. one hot conductor) from the source 36 to the heating element 34, rather than two as in the circuit 30 FIG. 2, the cost and complexity of the wiring harness can be reduced. The jumper wire 62 could also be an individual wire that is separate from the wiring harness. For example, the jumper wire 62 could be a short wire that runs directly between the output terminal H1 of the ON/OFF switch 50 to the input terminal L2 of the temperature level control switch 52. Rather than using a jumper wire 62 to connect the ON/OFF switch 50 to the temperature level control switch 52, a conductive jumper in the form of a metal bar or conductive trace can be built into the infinite switch 32 or connected to the terminals on the infinite switch. Whatever form of jumper is selected, be it a jumper wire 62, metal bar, etc., the jumper can have appropriate connectors for mating with the terminals H1, L2 on the infinite switch 32.

The heating element 34 is shown connected between the first electrical power terminal 38 and the output terminal H2 of the temperature level control switch 52. The heating element 34 could be connected between the second electrical power terminal 40 and the input terminal L1 of the ON/OFF switch 50, in particular when no pilot device is connected to the pilot terminal P of the ON/OFF switch.

Figure 4:
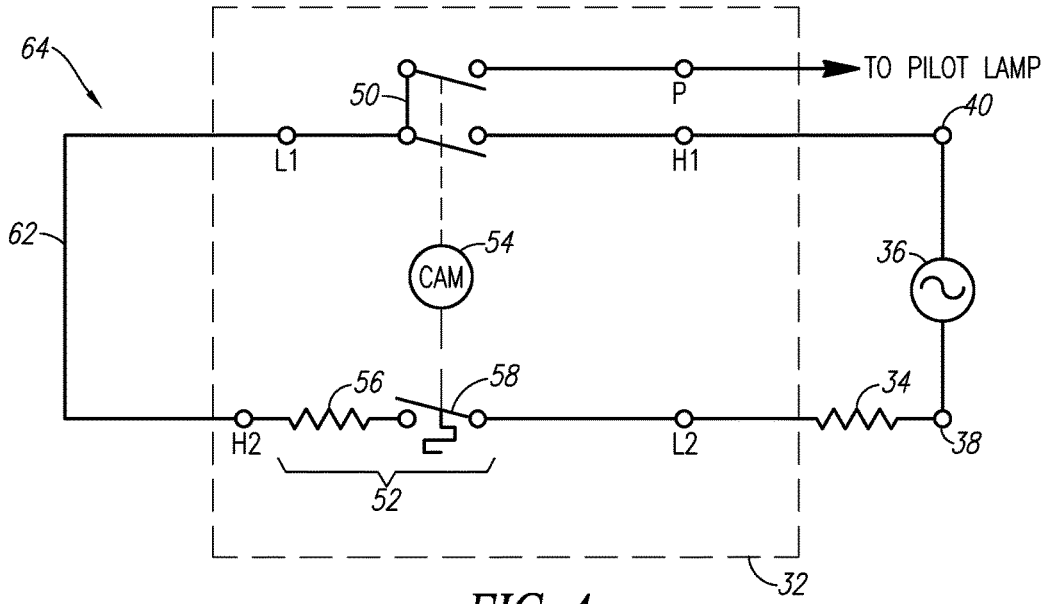
FIG. 4 is a schematic diagram of a power control circuit for a heating element.

FIG. 4 shows a further example power control circuit 64 that is similar to the circuit 60 in FIG. 3. In FIG. 4, the jumper wire 62 connects the input terminal L1 of the ON/OFF switch 50 to the output terminal H2 of the temperature level control switch 52. The heating element 34 is connected between the first electrical power terminal 38 at the source 36 and the input terminal L2 of the temperature level control switch 52. The output terminal H1 of the ON/OFF switch 50 is connected to the second electrical power terminal 40. Thus, the infinite switch 32 is connected in series with the heating element 34, between the heating element and the second electrical power terminal 40.

In FIG. 4, the heating element 34 is shown connected between the first electrical power terminal 38 and the input terminal L2 of the temperature level control switch 52. The heating element 34 could be connected between the second electrical power terminal 40 and the output terminal H1 of the ON/OFF switch 50, in particular when no pilot device is connected to the pilot terminal P of the ON/OFF switch.

Figure 5:
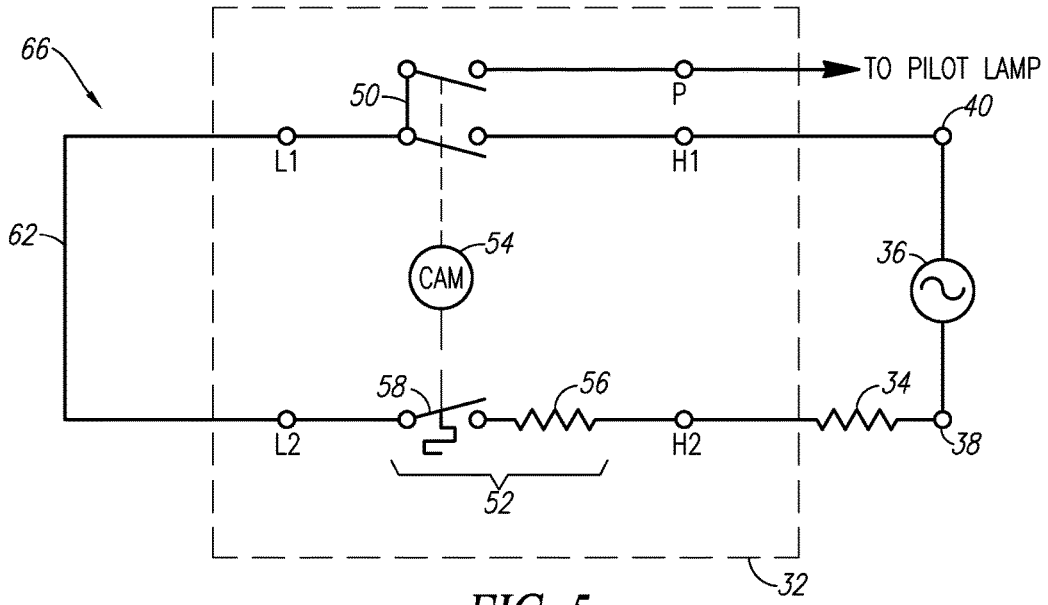
FIG. 5 is a schematic diagram of a power control circuit for a heating element.

FIG. 5 shows a further example power control circuit 66 that is similar to the circuit 60 in FIG. 3. In FIG. 5, the jumper wire 62 connects the input terminal L1 of the ON/OFF switch 50 to the input terminal L2 of the temperature level control switch 52. The heating element 34 is connected between the first electrical power terminal 38 at the source 36 and the output terminal H2 of the temperature level control switch 52. The output terminal H1 of the ON/OFF switch 50 is connected to the second electrical power terminal 40.

In FIG. 5, the heating element 34 is shown connected between the first electrical power terminal 38 and the output terminal H2 of the temperature level control switch 52. The heating element 34 could be connected between the second electrical power terminal 40 and the output terminal H1 of the ON/OFF switch 50, in particular when no pilot device is connected to the pilot terminal P of the ON/OFF switch.

Figure 6:
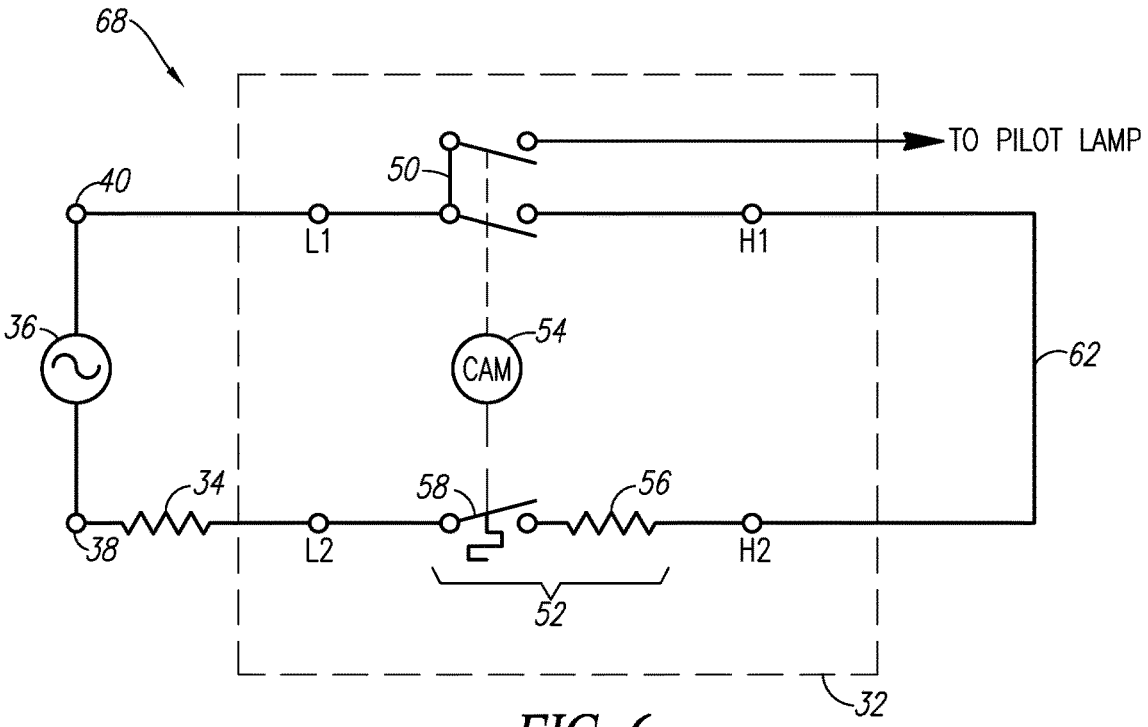
FIG. 6 is a schematic diagram of a power control circuit for a heating element.

FIG. 6 shows a further example power control circuit 68 that is similar to the circuit 60 in FIG. 3. In FIG. 6, the jumper wire 62 connects the output terminal H1 of the ON/OFF switch 50 to the output terminal H2 of the temperature level control switch 52. The heating element 34 is connected between the first electrical power terminal 38 at the source 36 and the input terminal L2 of the temperature level control switch 52. The input terminal L1 of the ON/OFF switch 50 is connected to the second electrical power terminal 40.

In FIG. 6, the heating element 34 is shown connected between the first electrical power terminal 38 and the input terminal L2 of the temperature level control switch 52. The heating element 34 could be connected between the second electrical power terminal 40 and the input terminal L1 of the ON/OFF switch 50, in particular when no pilot device is connected to the pilot terminal P of the ON/OFF switch.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A power control circuit for an appliance, comprising:

a first electrical power terminal and a second electrical power terminal, for electrical connection across a source of electrical power;

a heating element electrically connected to the first electrical power terminal;

a heating element controller electrically connected in series with the heating element, between the heating element and the second electrical power terminal, wherein the heating element controller is configured to control a temperature level of the heating element, the heating element controller comprising:

a control input configured to receive a range of temperature settings for the heating element, and configured to receive an OFF command for the heating element;

an ON/OFF switch operatively connected to the control input and having ON and OFF states selectively controlled by the control input, wherein the ON/OFF switch is configured to disconnect the heating element from the second electrical power terminal when in the OFF state; and a temperature level control switch operatively connected to the control input, and configured to intermittently connect the heating element to and disconnect the heating element from the second electrical power terminal in accordance with a temperature setting of the control input; and a jumper wire electrically connecting the ON/OFF switch to the temperature level control switch such that the ON/OFF switch and the temperature level control switch are connected to each other in series, wherein the ON/OFF switch, the jumper wire, the temperature level control switch, and the heating element are electrically connected in series such that electrical power from the source of electrical power is provided to the heating element through the ON/OFF switch, the temperature level control switch, and the jumper wire electrically connecting the ON/OFF switch to the temperature level control switch.

2. The power control circuit of claim 1, wherein the jumper wire electrically connects an ON/OFF switch terminal of the heating element controller to a temperature level control switch terminal of the heating element controller.

3. The power control circuit of claim 1, wherein the jumper wire is included in an appliance wiring harness.

4. A cooking appliance, comprising:

the power control circuit of claim 3; and a cooktop comprising the heating element.

5. The power control circuit of claim 1, wherein the heating element controller is an infinite switch.

6. The power control circuit of claim 5, wherein the ON/OFF switch comprises a pilot terminal configured to supply electrical power from the source of electrical power to a pilot device when the ON/OFF switch is in the ON state.

7. The power control circuit of claim 5, wherein the jumper wire is included in an appliance wiring harness, and the jumper wire electrically connects an ON/OFF switch terminal of the infinite switch to a temperature level control switch terminal of the infinite switch.

8. The power control circuit of claim 5, wherein the infinite switch comprises:

a first power input terminal and a first power output terminal connected across the ON/OFF switch from each other; and a second power input terminal and a second power output terminal connected across the temperature level control switch from each other, wherein the jumper wire electrically connects the first power output terminal to the second power input terminal, and the heating element is electrically connected between the second power output terminal of the infinite switch and the first electrical power terminal.

9. The power control circuit of claim 5, wherein the infinite switch comprises:

a first power input terminal and a first power output terminal connected across the ON/OFF switch from each other; and a second power input terminal and a second power output terminal connected across the temperature level control switch from each other, wherein the jumper wire electrically connects the first power input terminal to the second power output terminal, and the heating element is electrically connected between the second power input terminal of the infinite switch and the first electrical power terminal.

10. The power control circuit of claim 5, wherein the infinite switch comprises:

a first power input terminal and a first power output terminal connected across the ON/OFF switch from each other; and a second power input terminal and a second power output terminal connected across the temperature level control switch from each other, wherein the jumper wire electrically connects the first power input terminal to the second power input terminal, and the heating element is electrically connected between the second power output terminal of the infinite switch and the first electrical power terminal.

11. The power control circuit of claim 5, wherein the infinite switch comprises:

a first power input terminal and a first power output terminal connected across the ON/OFF switch from each other; and a second power input terminal and a second power output terminal connected across the temperature level control switch from each other, wherein the jumper wire electrically connects the first power output terminal to the second power output terminal, and the heating element is electrically connected between the second power input terminal of the infinite switch and the first electrical power terminal.

12. The power control circuit of claim 5, wherein:

the heating element controller is an infinite switch;

the control input is a control knob having a range of temperature setting positions for the heating element and an OFF position for the heating element;

the ON/OFF switch is operatively connected to the control knob through a cam device; and the temperature level control switch is operatively connected to the control knob through the cam device.

13. The power control circuit of claim 12, wherein the jumper electrically connects an ON/OFF switch terminal of the infinite switch to a temperature level control switch terminal of the infinite switch.

14. The power control circuit of claim 12, wherein the jumper is included in an appliance wiring harness.

15. A cooking appliance, comprising:

the power control circuit of claim 14; and a cooktop comprising the heating element.

16. The power control circuit of claim 12, wherein the ON/OFF switch comprises a pilot terminal configured to supply electrical power from the source of electrical power to a pilot device when the ON/OFF switch is in the ON state.

17. The power control circuit of claim 12, wherein the infinite switch comprises:

a first power input terminal and a first power output terminal connected across the ON/OFF switch from each other; and a second power input terminal and a second power output terminal connected across the temperature level control switch from each other, wherein the jumper electrically connects the first power output terminal to the second power input terminal, and the heating element is electrically connected between the second power output terminal of the infinite switch and the first electrical power terminal.

18. The power control circuit of claim 12, wherein the infinite switch comprises:

a first power input terminal and a first power output terminal connected across the ON/OFF switch from each other; and a second power input terminal and a second power output terminal connected across the temperature level control switch from each other, wherein the jumper electrically connects the first power input terminal to the second power output terminal, and the heating element is electrically connected between the second power input terminal of the infinite switch and the first electrical power terminal.

19. The power control circuit of claim 12, wherein the infinite switch comprises:

a first power input terminal and a first power output terminal connected across the ON/OFF switch from each other; and a second power input terminal and a second power output terminal connected across the temperature level control switch from each other, wherein the jumper electrically connects the first power input terminal to the second power input terminal, and the heating element is electrically connected between the second power output terminal of the infinite switch and the first electrical power terminal.

20. The power control circuit of claim 12, wherein the infinite switch comprises:

a first power input terminal and a first power output terminal connected across the ON/OFF switch from each other; and a second power input terminal and a second power output terminal connected across the temperature level control switch from each other, wherein the jumper electrically connects the first power output terminal to the second power output terminal, and the heating element is electrically connected between the second power input terminal of the infinite switch and the first electrical power terminal.

21. A cooking appliance, comprising:

the power control circuit of claim 1;

a cabinet forming an oven cavity;

a cooktop including the heating element; and a user interface including a control input for the heating element and a pilot device for the heating element, wherein:

the heating element controller is an infinite switch electrically connected in series with the heating element the ON/OFF switch has a pilot terminal configured to supply electrical power from the source of electrical power to the pilot device when the ON/OFF switch is in the ON state; and the jumper wire is included in an appliance wiring harness, electrically connecting an ON/OFF switch terminal of the infinite switch to a temperature level control switch terminal of the infinite switch such that the ON/OFF switch and the temperature level control switch are connected to each other in series.

22. The power control circuit of claim 1, wherein the control input is operatively connect the ON/OFF switch by a cam.

23. The power control circuit of claim 1, wherein the control input receives the OFF command when the ON/OFF switch is in the OFF state.

* * * * *